US005700008A

United States Patent [19]

Lawlor et al.

[11] Patent Number: 5,700,008

[45] Date of Patent: Dec. 23, 1997

[54] AMUSEMENT DEVICE INTEGRATING GAMES OF SKILL AND CHANCE

[75] Inventors: Patrick Lawlor, Marengo; Matthew C. Coriale, Algonquin, both of Ill.

[73] Assignee: Williams Electronics Games, Inc., Chicago, Ill.

[21] Appl. No.: 796,940

[22] Filed: Feb. 7, 1997

Related U.S. Application Data

[63] Continuation of Ser. No. 604,406, Feb. 21, 1996, abandoned.

[51] Int. Cl.[6] ..... A63F 7/00

[52] U.S. Cl. ..... 273/118 A; 273/108; 273/138.1; 273/236; 273/121 A; 273/118 R; 273/119 A

[58] Field of Search ..... 273/118, 119, 273/121, 108, 138.1, 236

[56] References Cited

U.S. PATENT DOCUMENTS

| | | | |
|---|---|---|---|
| 3,275,322 | 9/1966 | Burnside | 273/119 A |
| 3,993,312 | 11/1976 | Burnside . | |
| 4,017,077 | 4/1977 | Burnside . | |
| 4,363,485 | 12/1982 | Edwall | 273/121 A |
| 4,375,286 | 3/1983 | Seitz et al. | 273/121 A |
| 4,380,335 | 4/1983 | Chaudhry et al. | 273/121 A |
| 4,685,677 | 8/1987 | Demar et al. . | |
| 5,259,616 | 11/1993 | Bergmann . | |
| 5,342,049 | 8/1994 | Wichinsky et al. | 273/121 A |
| 5,393,057 | 2/1995 | Marnell, II . | |

OTHER PUBLICATIONS

BWB Neward Ltd., Sinbad Operating Manual, Aug. 1995, England.

*Primary Examiner*—Raleigh W. Chiu
*Attorney, Agent, or Firm*—Rudnick & Wolfe

[57] ABSTRACT

A game of skill, such as a pinball game is integrated with a game of chance, such as a simulation of a board game. A micro-processor based control system permits play of the game of chance when a player achieves game objectives in the skill game. The game of chance is played using random number selection to determine the "moves" on the simulated board game. The player may continue the game of chance until he wins the game or he may stop at a designated point and return to the game of skill. The game of chance simulation may include a plurality of lights arranged in patterns to simulate board game paths.

13 Claims, 4 Drawing Sheets

AMUSEMENT DEVICE INTEGRATING GAMES OF SKILL AND CHANCE

This application is a continuation of application Ser. No. 08/604,406 filed Feb. 21, 1996, now abandoned.

BACKGROUND OF THE INVENTION

This invention relates to the field of amusement games in general and coin-operated amusement games typically found in arcades in particular. One variety of amusement game which is well known in this art is the rolling ball game typified by a pinball game in which one or more rolling balls are moved about on an inclined horizontal surface. The playfield includes play features and various obstacles around which a skillful player must maneuver the ball to score points or otherwise achieve game objectives. The player guides the ball(s) on the playfield using various types of player controlled devices including flippers, magnetics, solenoids or other propelling devices.

To maintain player interest such skill games must have a strike balance between being too easy and to difficult. Indeed, in an effort to tailor games for the environment in which they operate, it is usual to provide a micro-processor based controller which can alter the skill level required to achieve game objectives or awards either manually or automatically. See, for example U.S. Pat. No. 4,685,677 to DeMar et al for a discussion of a pinball system in which the replay level, the score required for the award of a free game, is automatically changed depending upon the average level of player skill detected by the game over a period of time.

In a different category are home board games which can be enjoyed by a wide variety of adults and children. Such games are typically referred to as games of chance because there is much more luck than skill involved in their play. A typical board game, for example, requires players to move along a path from a starting point to an end point achieving game objectives along the way. Movement along the paths is usually controlled by a random selection device, such as a pair of dice. MONOPOLY, CHUTES AND LADDERS, SORRY and PARCHESI are all examples of this genre.

It is desired to add the excitement and novelty of a board game to a coin-operated amusement device such as a rolling ball game, thereby to enhance the device and create increased player appeal. Accordingly, it is an object of the present invention to provide an amusement device integrating a rolling ball game with a "board type game".

A further object of the invention is to provide a micro-processor based amusement device in which a player who achieves game objectives attains the right to play a board game and win additional awards. A further object of the invention is to provide an integrated pinball and display game, the latter consisting of light displays contained in the backbox of a pinball type cabinet. These and other objectives, will become apparent to those skilled in the art from the detailed description of the invention provided below.

DETAILED DESCRIPTION OF THE INVENTION

Figure 1:
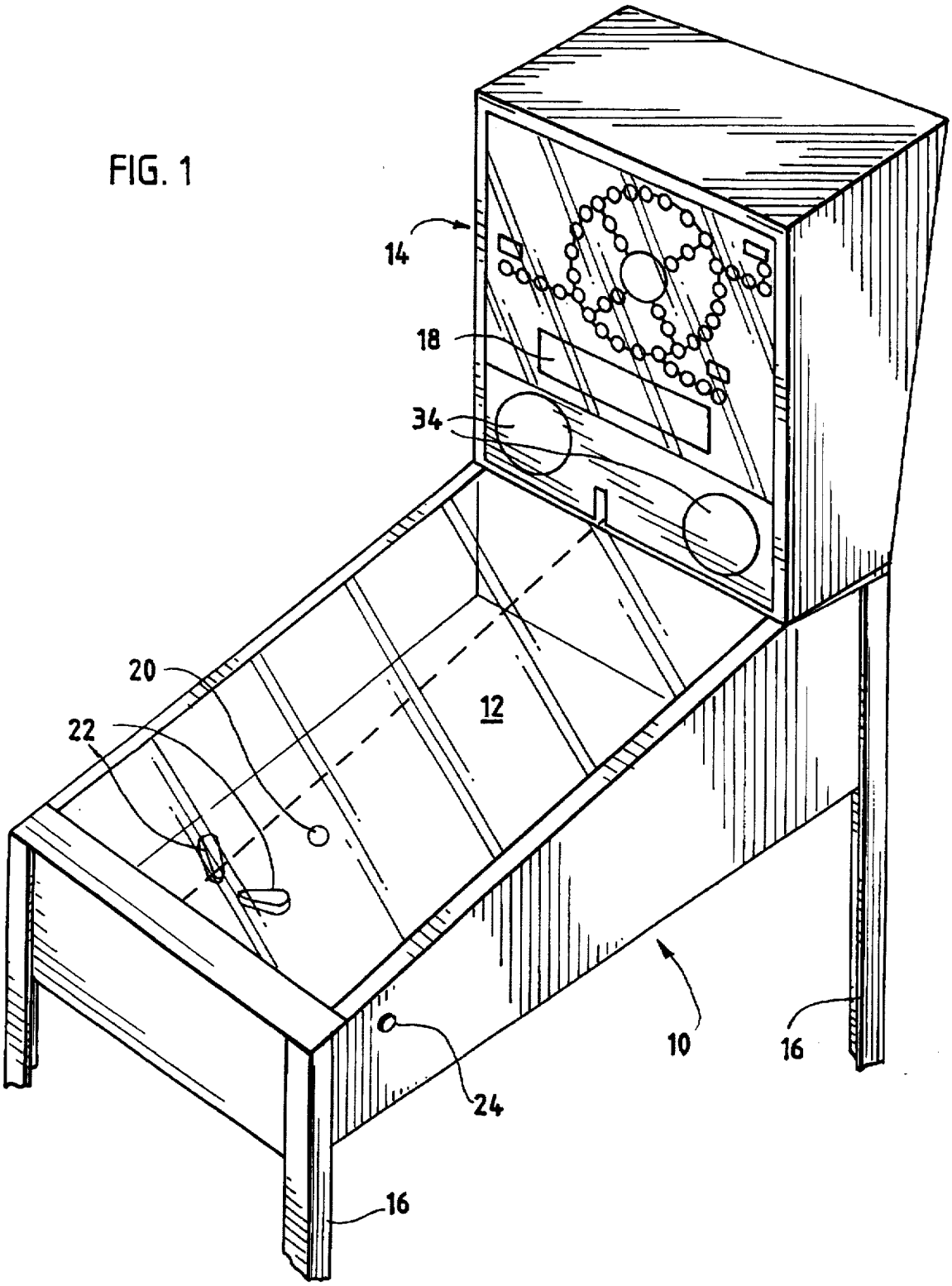
FIG. 1 is a perspective view of a game cabinet suitable for use with the present invention.

Referring to FIG. 1, a game cabinet 10 includes a horizontally disposed playfield 12 and a vertically disposed backbox 14. The cabinet is supported on the floor by legs 16. Disposed on the playfield 12 are a plurality of play features (not shown for clarity) of the type well known in the pinball art. These include jet bumpers, roll-over switches, stand-up targets, ramps and the like. One or more rolling balls are employed in the game to interact with the playfield features to score points and achieve game objectives. Points are displayed on an alpha-numeric display 18 operated by the micro-processor system of FIG. 3. Display 18 is also capable of computer generated animations and can provide information to the player both before and during game operation. The rolling ball shown at 20 is maneuvered on the playfield by operation of player controlled devices such as flippers 22 or other devices well known in the art. Typically, these are activated by switch buttons on the side of the cabinet as indicated at 24. To protect the playfield from abuse, a pane of glass or similar material is typically disposed above and spaced from the playfield as indicated at 26.

In the usual rolling ball game, whether of the pinball type or a novelty type such as a baseball game, the player seeks to obtain extra balls, high scores, replays and the like by skillful manipulation of the pinball on the playfield thereby to interact with the scoring features. The status of the game and the players current score are indicated on the display 18 as previously indicated.

Figure 2:
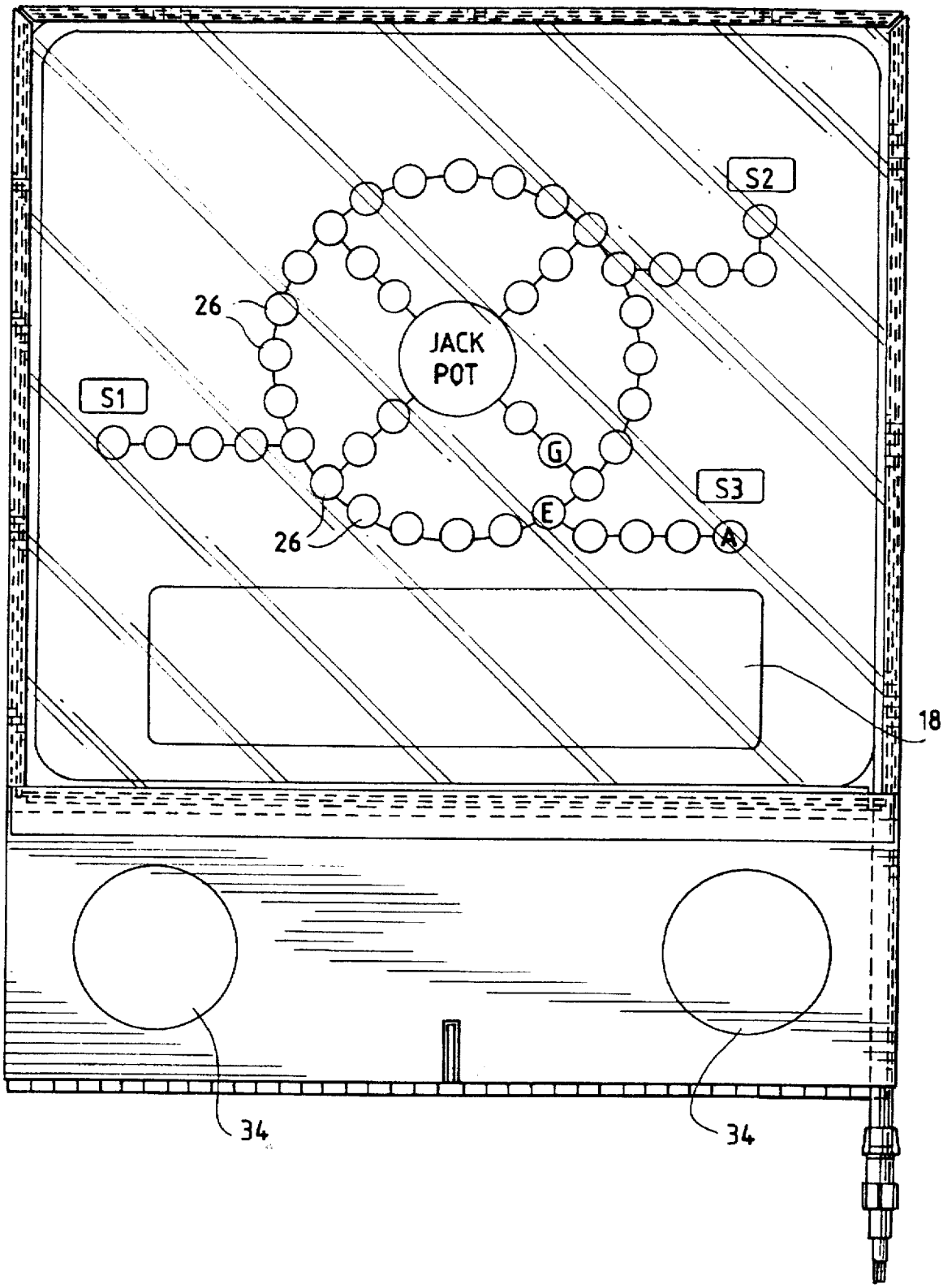
FIG. 2 is a from elevation of the backbox of the cabinet of FIG. 1 illustrating the board game simulation.

In order to provide an additional dimension of entertainment, it is contemplated, according to the invention, that a simulated board game will be incorporated into the cabinet, preferably in the backbox 14 as illustrated more fully in FIG. 2. In FIG. 2, a board game simulation is provided consisting of a plurality of illumination devices such as light bulbs or LED's indicated in the drawings by circles 26. The bulbs simulate the paths typical of many board games along which a player "moves" in accordance with the throw of a pair of dice. Game information is associated with each location along the path. In the illustrated embodiment, there is shown a wheel and spoke arrangement having three starting points indicated as S1, S2 and S3. It should be understood that this arrangement is for illustrative purposes only and any board game path arrangement desired may be utilized. It is contemplated by the invention that the player of the skill game who achieves the desired game objectives will become entitled to play the game of chance disposed on the backbox. Depending upon the manner in which the player qualified for the board game simulation he will start at one of the three indicated starting points S1, S2 or S3.

The game processor will, upon a signal from the player, or automatically if preferred, generate a random number corresponding to the number of spaces (lights) that the player is to move from a start position. For example, a player starting at S3, Lamp A, might move five spaces to Lamp E. Lamp E has associated therewith one of several possible attributes. It might award a prize such as a game token, it could give another turn, i.e., "roll again", it could require movement to a different location along the path or it could impose a penalty as, for example, loss of the game or return to start.

Once the player reaches the selected location, he is preferably given an option by the game processor to continue with the game of chance or to take any prizes awarded thus far and return to the game of skill. This decision can be communicated to the processor using any of the player-operated switches associated with the game such as flipper switch 24. If the player chooses to continue another random number is generated and the lights are illuminated to simulate movement along the path to the next location, for example, Lamp G.

In the illustrated embodiment, one object of the game of chance is to reach the center circle, designated jackpot, which can award a plurality of tokens, for example, for additional play of the amusement device. Use of the tokens may permit enhanced game play not ordinarily obtainable by the mere insertion of coins into the game. This aspect of the invention will be discussed hereafter. In any event, the game of chance may continue as long as the player wishes until he either wins, decides to quit and return to the skill game or loses.

In the event that the player returns to the skill game, his position on the board game may be maintained or not as determined by the rules of the game until the skill game itself terminates. Thus, there may be several opportunities, according to the game rules of the device, for the player to go back and forth between the skill game and the board game simulation. Play of the skill game may be conducted in any of several ways. First, and more traditionally, a set number of balls can be provided to the player for each game. Typically three balls are awarded for a single play. According to the present invention, it may be advantageous to utilize a different mode of play in which time controls the operation of the skill game. Thus, upon insertion of a coin, the player is given a fixed period of time to achieve required game objectives leading to play of the game of chance. During this time period, the player is given an unlimited number of balls whenever necessary as, for example, when a ball "drains" into an outhole. In the event that the timed embodiment is employed, the timer may be stopped during play of the board game with any remaining portion of skill game time being provided upon returning to the skill game.

Figure 3:
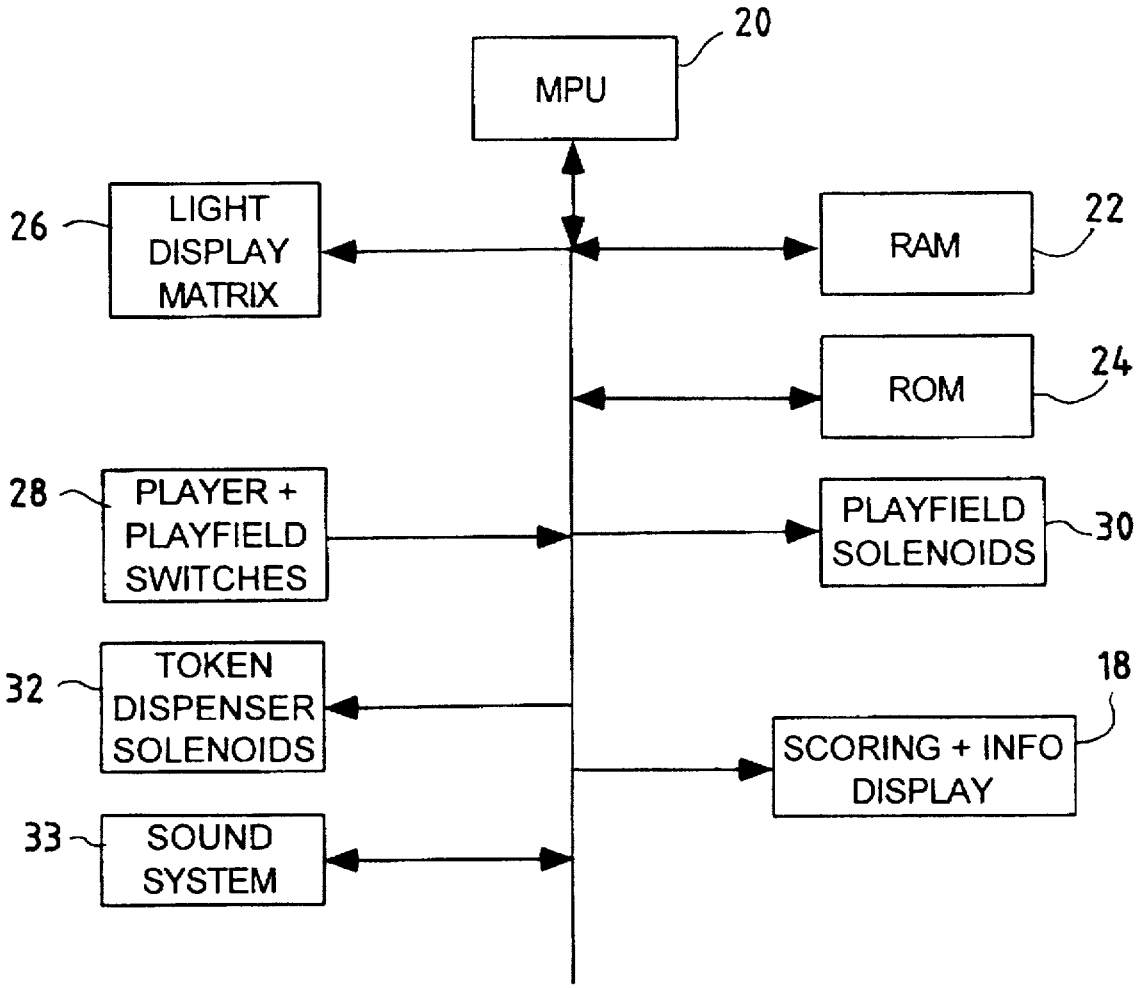
FIG. 3 is a block diagram of a micro-processor based control system for use with the invention.

Referring to FIG. 3, them is illustrated a block diagram of a game control system suitable for use with the present invention. A micro-processor 20 is connected by an address and data bus to the usual RAM and ROM memories 22 and 24. The ROM memory contains the game program including the rules of the game. The RAM memory is utilized for operation of the game, to store game specific information such as scores, time remaining, etc. The micro-processor operates the various lights in the playfield and the backbox via a lamp display matrix 26. It also interrogates the various playfield switches 28 to determine the location of the rolling ball and awards points for actuating scoring features. Playfield solenoids 30 are provided to alter the movement of the pinball as, for example, the use of bumpers and slingshots. As indicated, the game typically includes a display 18 and this is also connected to the bus so that the micro-processor can communicate with the player by means of the display. In the illustrated embodiment, it is also contemplated that a token dispenser 32 will be included in the device whereby tokens may be dispensed to the player for achieving certain game objectives either in the skill or chance games. The token dispensers can be of any desired type and may be located either in the horizontal cabinet or in the backbox 14. To dispense a token the micro-processor operates one or more solenoids associated therewith. A sound system 33 may also be included for providing music and digitized speech to enhance the enjoyment of the game. For that purpose, speakers 34 are provided in the backbox.

Figure 4:
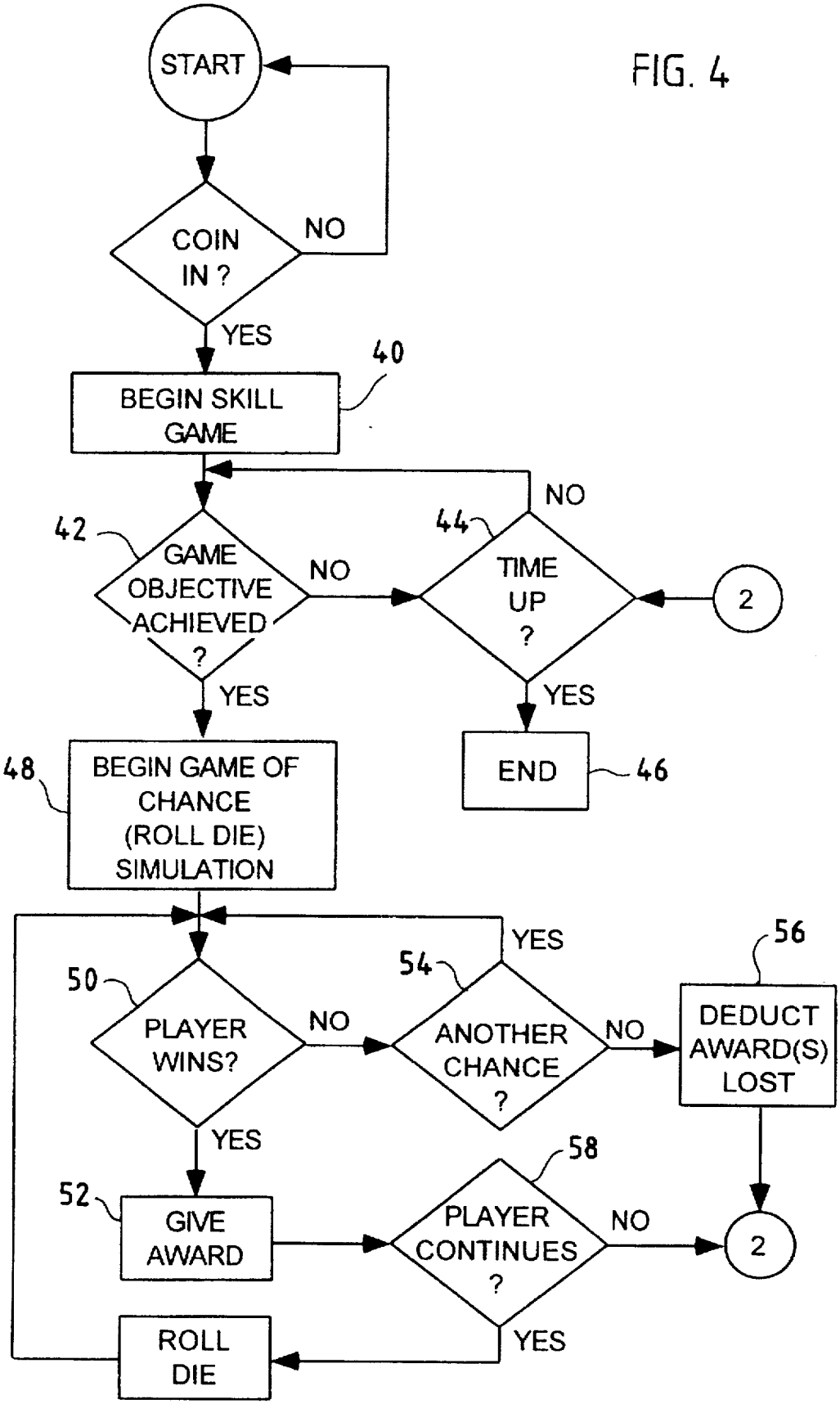
FIG. 4 is a software flow diagram illustrating the preferred manner in which the invention operates.

Referring to FIG. 4, there is disclosed a flow diagram illustrative of the manner in which the game processor system operates. The indicated functions can be readily programmed by those skilled in the art in many desired programming languages for any processor system desired. The flow diagram in FIG. 4 is intended to be illustrative of a program suitable for implementing the invention, but it will be apparent to the routineer that many variations are possible, some of which will be disclosed hereafter.

Upon inserting a coin into the device, the skill game begins, Step 40. As indicated, the skill game is preferably a rolling ball game which requires player input to achieve game objectives. Unless and until these objectives are achieved, game play of the rolling ball game continues until time is up as indicated at steps 42 and 44. Alternatively, the game may be limited by other than time, as for example, there may be a three ball limit per game. When time is up or the number of balls allowed have been played, the game ends, step 46.

If, prior to the skill game ending, the player does achieve one or more of the required game objectives, the skill game is suspended and the game of chance, namely the board game simulation commences, step 48. According to a preferred embodiment of the present invention, the game of chance is a board game simulation in which a plurality of indicator means such as lamps, diodes, or other signalling devices are arranged in patterns on a playfield backboard or other surface associated with the amusement device. The microprocessor communicates with the indicator means via the bus system illustrated in FIG. 3 to selectively illuminate one or more of the indicator means. Selection of a particular indicator is accomplished, in its simplest form, by use of a random number generator (RNG) algorithm either hard wired into the processor system or provided in its software programming. Thus, for example, the RNG function could pick a number from one to six to simulate the throwing of a die and then illuminate the indicators along the path in a manner which would indicate movement to the number selected. The indicator selected remains illuminated and the player is awarded the prize, penalty or game feature associated with the selected indicator. Typically, the prize, penalty or game feature so associated with an indicator will be marked on or near the indicator so the player can readily determine what has occurred. Examples of these features include win a token, win a jackpot, lose a turn, revert to the skill game, take another turn, advance three spaces, etc.

After selecting the indicator to be illuminated, the program determines if the player has won, step 50, and, if so, issues the award, step 52. In the case of a token, a token dispenser would be activated. If the player has not won, it is determined, at step 54, whether the game is over or the player is to be given another turn. If another turn is permitted, another random number is selected and step 50 is repeated. If the player lands on a losing indicator, he may lose an award which he has won, for example, a free game, an extra ball, additional time, etc and this may be deducted at step 56. If the player is not permitted another chance, the game of chance terminates and the program returns to step 44 to determine if the skill game should resume. Termination of the board game can occur in several ways depending upon the desire of the game designer. At step 58, the player may be given an opportunity to select whether he wishes to continue to play the board game. His selection may be input to the processor system by means of a player controlled switch, for example, a flipper switch. Alternatively, the player may choose to continue the board game in an effort to win more prizes. The feature represented by step 58 may be selectively enabled by the game owner/operator or it may be omitted if desired. The basic programming outlined in FIG. 4 provides the framework for integrating operation between the skill game and the game of chance whereby a skillful player is given the opportunity to play the board game which is, of course, a game of luck based on random number selection.

As thus far described, the invention employs an RNG to select the indicators for the player. It may be desirable to have closed loop control over the frequency with which prizes are awarded so that this does not become excessive. For that purpose, the computer program may include routines to monitor game play statistics, including number of games played, skill level of the player, number of tokens, free games, extra balls, etc. awarded in the game of chance and similar data. The data may be expressed as a percentage and this percentage may in turn be compared against a desired percentage to ensure that the awards given approximate the desired percentage. When a deviation is detected, the processor alters the operation of the RNG to increase or decrease the award percentage to maintain it within the desired range. The percentaging system contemplated for use with the invention employs techniques similar to those disclosed in U.S. Pat. No. 4,685,677 to DeMar et at, assigned to the present assignee, which patent is hereby incorporated by reference.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed:

1. An amusement device comprising:

a) a rolling ball game including an inclined playfield, at least one rolling ball for movement on said playfield, scoring features disposed on said playfield activated by said ball and player operated means for controlling the movement of the ball on said playfield;

b) a board game simulation associated with said rolling ball game, said board game simulation including indicator means arranged in patterns to simulate board game paths, each indicator means corresponding to a prize, a penalty or game feature;

c) processor means for: (i) operating the rolling ball game; (ii) initiating operation of said board game simulation; (iii) selecting indicator means along said game paths to award the prize, penalty or game feature associated therewith until a player wins, loses or signals said processor means to terminate the board game simulation.

2. The device of claim 1 wherein said indicator means include lamps which are selectively illuminated by said processor means to indicate movement and selection.

3. The device of claim 1 wherein said processor means includes timer means for operating said rolling ball game on a time limit basis permitting play to continue until time runs out or game objectives have been achieved thereafter permitting initiation of said board game simulation.

4. The device of claim 1 wherein said processor means includes a random number generator (RNG) for selecting said indicator means.

5. The device of claim 4 wherein said processor means further includes means for maintaining historical game data including wins, loses, free games, tokens awarded.

6. The device of claim 5 wherein said processor means further comprises means for selecting the desired win percentage of said board game including: (i) means for calculating and comparing the desired win percentage to the actual percentage based on said historical game data; and (ii) means for altering the operation of said RNG to maintain the desired win percentage.

7. The device of claim 1 wherein the processor means includes means for detecting achievement of game objectives in said rolling ball game and for initiating operation of said board game simulation responsive thereto.

8. An amusement device comprising:

a) a rolling ball game including an inclined playfield, at least one rolling ball for movement on said playfield, scoring features disposed on said playfield activated by said ball and player operated means for controlling the movement of the ball on said playfield, thereby to permit skillful players to achieve rolling ball game objectives;

b) a game of chance associated with said rolling ball game, said game of chance including indicator means corresponding to a prize, a penalty or game outcome;

c) processor means for: (i) operating the rolling ball game including determining when game objectives have been achieved; (ii) initiating operation of said game of chance responsive to achieving said rolling ball game objectives; (iii) selecting indicator means and awarding the player the prize, penalty or game feature associated therewith until a player wins, loses or signals said processor means to terminate the game of chance.

9. The device of claim 8 wherein said indicator means include lamps which are selectively illuminated by said processor means to indicate which has been selected.

10. The device of claim 8 wherein said processor means includes timer means for operating said rolling ball game on a time limit basis permitting play to continue until time runs out or game objectives have been achieved thereafter to initiate said game of chance.

11. The device of claim 8 wherein said processor means includes a random number generator (RNG) for selecting said indicator means.

12. The device of claim 11 wherein said processor means further includes means for maintaining historical game data including wins, loses, free games, tokens awarded.

13. The device of claim 12 wherein said processor means further includes means for selecting the desired win percentage of said board game including: (i) means for calculating and comparing the desired win percentage to the actual percentage based on said historical game data; and (ii) means for altering the operation of said RNG to maintain the desired win percentage.

* * * * *